US005381911A

United States Patent [19]

Teicher et al.

[11] Patent Number: 5,381,911

[45] Date of Patent: Jan. 17, 1995

[54] CHILD-RESISTANT CONTAINER CLOSURE

[75] Inventors: Mordechai Teicher, Kfar Saba; Itzhak Bar-Yona, Neve Monoson, both of Israel

[73] Assignee: Log-Plastic Products, Ashdod, Israel

[21] Appl. No.: 73,192

[22] Filed: Jun. 8, 1993

[51] Int. Cl.[6] ..... B65D 55/02

[52] U.S. Cl. ..... 215/216; 215/202; 215/305

[58] Field of Search ..... 215/216–221, 215/305, 202, 201

[56] References Cited

U.S. PATENT DOCUMENTS 1,536,067 5/1975 Blinn ..... 215/202

4,548,329 10/1985 Curry ..... 215/216

*Primary Examiner*—Joseph Man-Fu Moy

*Attorney, Agent, or Firm*—Benjamin J. Barish

[57] ABSTRACT

A child-resistant closure for a container includes a cap constructed and dimensioned such that it can be gripped and moved to open the container by the hand of the size of an adult but not of a child.

5 Claims, 9 Drawing Sheets

CHILD-RESISTANT CONTAINER CLOSURE

FIELD AND BACKGROUND OF THE INVENTION

The present invention relates to child-resistant container closures, that is, container closures designed to prevent opening of the container by children.

Containers for many articles (e.g., drugs and household chemicals) which may be harmful to children are required to have child-resistant closures to prevent the removal of the closure by a child. Various types of child-resistant closures have been developed and are now in use for this purposes. The known types generally discriminate between children and adults by either a complicated, non-instinctive mode of operation (e.g., "dial and push", or "push and turn"), by the need for a relatively large force, or by the combination of the above. However, while the opening of such child-resistant closures is problematical for children, it is also problematical for elderly persons. Such an elderly person may therefore have to obtain the assistance of another person to open the closure, but may not reclose the container because of this inconvenience in reopening it, thereby rendering ineffective the protection against the danger of the container contents being accessible to children.

OBJECT AND BRIEF SUMMARY OF THE INVENTION

An object of the present invention is to provide a container closure which is both child-resistant and elderly-friendly, i.e., which is difficult to open by a child but not by an elderly person.

According to the present invention, there is provided a child-resistant closure for a container including a cap to be gripped and moved relative to the container by the hand of a person to open the closure, characterized in that the cap is constructed and dimensioned such that it can be gripped and moved to open the container by the hand of the size of an adult, but not by the hand of the size of a child.

In some described embodiments, the cap has an outer circumferential portion required to be enclosed and gripped by a finger and the thumb of a person to open the container, and the outer circumferential portion of the cap includes a pair of finger-engaging elements which are spaced apart in one circumferential direction less than the distance between the tips of the finger and thumb of an adult but more than that of a child, such that the finger-engaging elements can be pressed toward each other in the opposite circumferential direction when so enclosed and gripped by an adult but not by a child. The cap is of a construction which requires, for its removal from the container, the pressing of the pair of finger-engaging elements toward each other when enclosed and gripped by the finger and thumb of the person attempting to open the container.

In another described embodiment, the container includes a neck formed with external threads, and the cap is formed with internal threads such that rotating the cap in one direction tightens the cap on the container neck, and rotating the cap in the opposite direction loosens the cap to permit it to be removed from the container neck; the container and cap each including locking means normally inter-engaging with each other so as to prevent rotation of the cap relative to the container, the locking means of the cap being displaceable by finger pressure to disengage from the locking means of the container thereby to permit rotation of the cap relative to the container.

The invention thus exploits the difference in the size of the hand of a child (usually defined by standard test protocols as up to 51 months of age) as compared to that of an adult, particularly the perimeter the hand can fully grip, as the discriminating factor in making the closure both child-resistant and elderly-friendly.

In an examination of fifty children of about 51 months of age and fifty adults over forty years of age, it was found that no child could form a gripping circumference between a finger (e.g., the index finger or the middle finger) and the thumb equal to 115 mm, while all fifty of the adults could do so easily. Accordingly, the finger-engaging elements should preferably be spaced apart from each other in the one circumferential direction slightly less than 115 mm, e.g., from 105–115 mm, so that an adult but not a child can easily press the two elements toward each other.

According to a further feature in many described embodiments, the protective means is effective only during the initial loosening movement to prevent rotation of the cap in the loosening direction unless the pair of finger-engaging elements are pressed toward each other; after the initial loosening, the cap may be rotated in the conventional manner.

In several described embodiments, the cap may be constructed of a single part to be used with containers specially constructed to cooperate with such a cap. Other embodiments are described which are usable with existing conventional containers. In these embodiments, the cap includes an inner cap part threadedly applied to the neck of the container, and an outer cap part which is normally decoupled from the inner cap part but becomes coupled thereto when the pair of finger-engaging elements are pressed toward each other.

Many of the described embodiments include protection against a child reaching the pair of finger-engaging elements by placing the hand over the top of the cap. According to further features described below, this may be done by providing the cap with sufficient axial length, or with a shield between its top and the finger-engaging elements, effective to prevent the child from reaching the pair of finger-engaging elements in this manner. One described embodiment provides the outer surfaces of these elements with slanted faces which prevent them from being gripped from the side with sufficient firmness to rotate the cap.

A closure constructed in accordance with the above features is both child-resistant and elderly-friendly since it discriminates between the two by the size of the opener's hand. Another important advantage in many of the described embodiments is that the protective means provided to prevent removal of the cap by a child also prevents loosening of the cap during transportation of the container, thereby obviating the need for a special securing device commonly provided for this purpose.

BRIEF DESCRIPTION OF THE DRAWINGS

The invention is herein described, by way of example only, with reference to the accompanying drawings, wherein.

DESCRIPTION OF PREFERRED EMBODIMENTS

The Embodiment of FIGS. 1–4

The embodiment of the invention illustrated in FIGS. 1–4 includes a cap of a one-part construction. However, it requires modifications in the construction of the container, and therefore would not be usable with containers of conventional construction.

Figure 1:
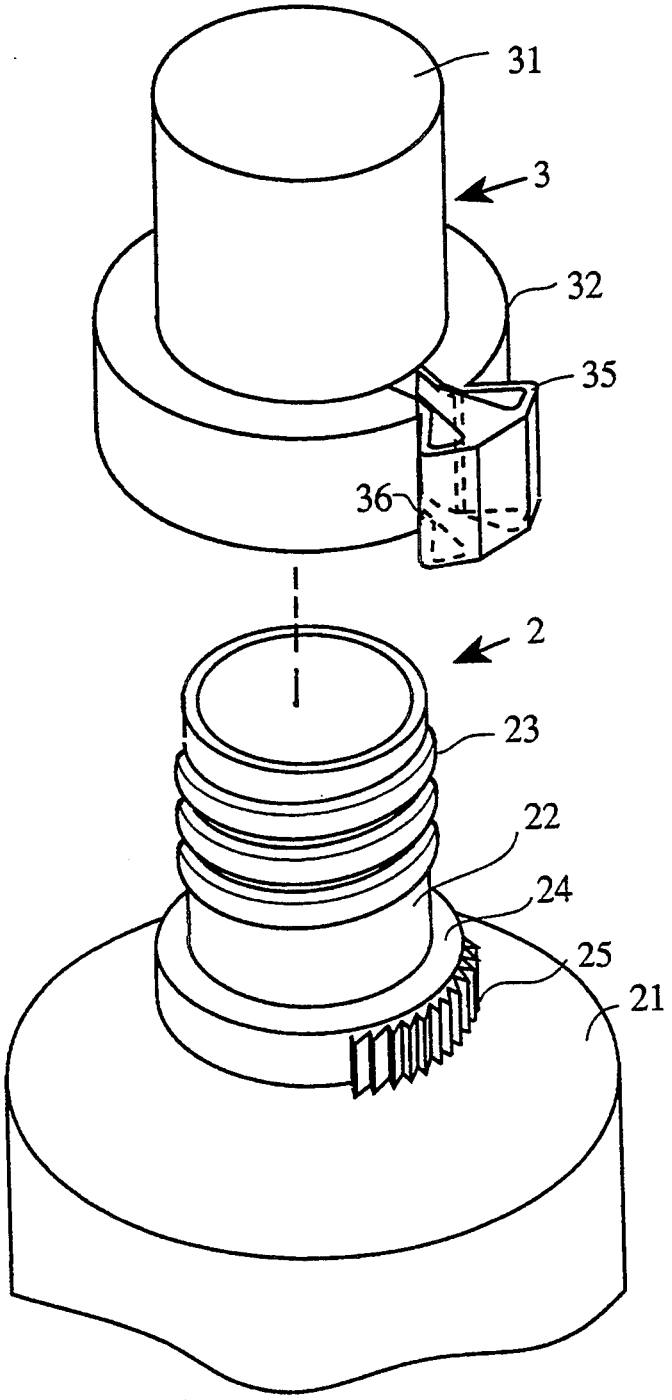
FIG. 1 is a three-dimensional, exploded view illustrating one form of container and closure cap constructed in accordance with the present invention.
Figure 2:
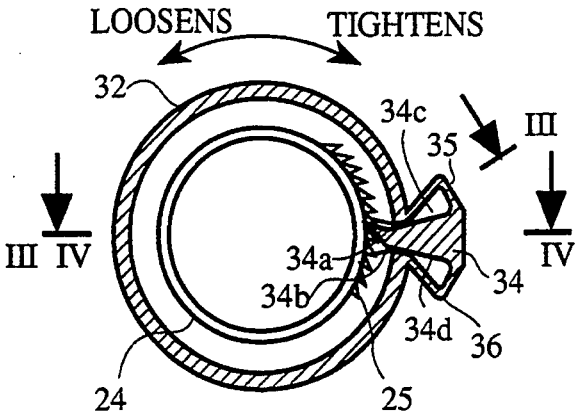
FIG. 2 is a transverse sectional view through the cap of FIG. 1.
Figure 3:
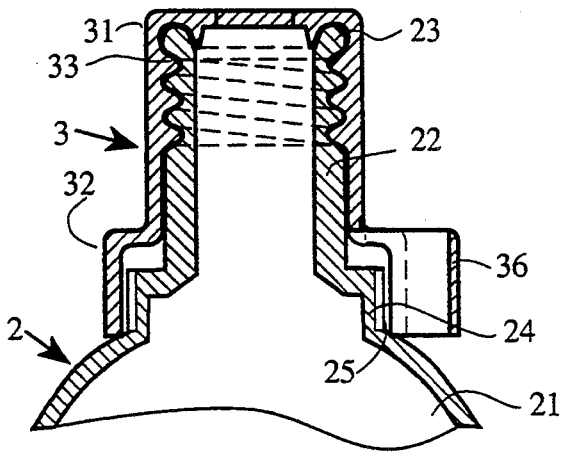
FIGS. 3 and 4 are sectional views along lines III—III and IV—IV, respectively, of FIG. 2.
Figure 4:
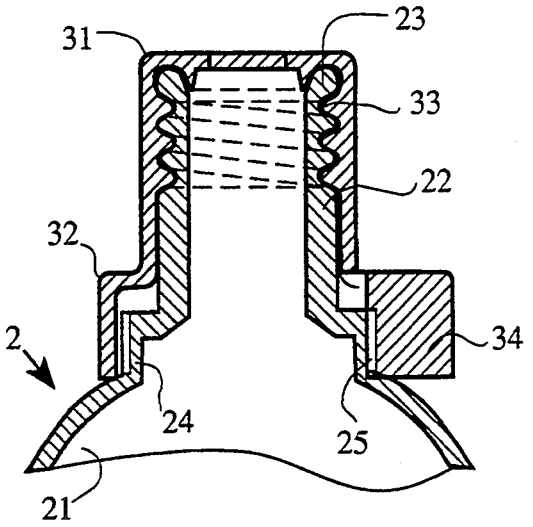

The closure illustrated in FIG. 1 comprises a container, generally designated 2, and a cap, generally designated 3, removably applied to the container. The container 2 is formed with a main section 21 for receiving the container contents (e.g., pills, household chemicals, or other material which may be harmful to a child), and a neck 22 at the upper end of the container for receiving the cap 3. Neck 22 is formed with external threads 23 cooperable with internal threads formed in cap 3. The base of neck 22 is of enlarged diameter, as shown at 24, and is formed with ratchet teeth 25 cooperable with a projection in cap 3, as will be described below.

The cap 3 in the container closure illustrated in FIG. 1 includes a top section 31 adapted to enclose neck 22 of the container, and a lower skirt section 32 having an outer circumferential surace of slightly larger diameter to enclose the enlarged base 24 of the container neck 22. The top section 31 of the cap is formed with internal threads 33 cooperable with the external threads 23 in the container neck 22, such that rotating the cap in one direction (clockwise in FIG. 2) tightens the cap, and rotating it in the opposite direction loosens the cap. The lower skirt section 32 of cap 3 which encloses the neck base 24 includes a projection 34 (FIG. 2) which is cooperable with the ratchet teeth 25 formed in the neck base 24. Projection 34 is spring-urged so as to be received between the teeth 25. Projection 34 and the teeth 25 are configured to permit rotation of the cap in the tightening direction (clockwise, FIG. 2) without withdrawing projection 34, but to prevent rotation of the cap in the loosening direction (counter-clockwise, FIG. 2) unless the projection is first withdrawn from the teeth.

Projection 34 may be withdrawn from the ratchet teeth 25 by pressing toward each other a pair of finger-engaging elements 35, 36 integrally joining projection 34 with cap section 32. Projection 34 is of generally triangular shape such that its tip 34*a* is pointed and projects through a slit 34*b* in the cap, whereas its opposite sides 34*c*, 34*d* serve as inclined cam surfaces engageable with the inner surfaces of elements 35, 36 at the edges of slit 34*b*. Thus, the finger-engaging elements 35, 36, serve as integral hinges joining projection 34 with the cap section 32 and urge the pointed tip 34*a* of the projection into engagement with the ratchet teeth 25 of the container neck 22; but when the finger-engaging elements 35, 36 are pressed toward each other, the edges of slit 34*b* engage the cam surfaces 34*c*, 34*d* of projection 34, to cam the projection out of engagement with the ratchet teeth 25.

It will thus be seen that in order to remove cap 3 from the container neck 22, it is necessary to enclose and grip the outer circumferential surface of the skirt portion 32 of the cap between the thumb and a finger (e.g., the index finger or middle finger), and to press the two finger-engaging elements 35, 36 toward each other, to thereby remove projection 34 from engagement with the ratchet teeth 25. The two finger-engaging elements 35, 36, however, are spaced from each other a distance which is less than the distance between the tips of an adult's thumb and index (or middle) finger, but larger than the distance between the tips of a child's thumb and index (or middle) finger. Thus, an adult, but not a child, is able to press these two elements toward each other while gripping and thereby to withdraw projection 34 from ratchet teeth 25.

Since children of (usually defined as up to 51 months of age) cannot generally form a grip of 115 mm in circumference between the tips of the index (or middle) finger and the thumb, whereas adults can, the distance between the finger-engaging elements 35, 36 should be slightly less than 115 mm, e.g., 105–114 mm, so that an adult would be able to press these elements toward each other sufficient to withdraw projection 34, whereas a child would not be able to do so.

The manner of using the container closure illustrated in FIGS. 1–4 will be apparent from the above description. Thus, the cap 3 may be easily applied to the container neck 22, whereupon projection 34 seats between the ratchet teeth 25. The ratchet teeth 25 are configured, as described earlier, such that the cap may be rotated in the tightened direction (clockwise, FIG. 2) without squeezing the two finger-engaging elements 35, 36 toward each other. However, projection 34, being spring-urged between the ratchet teeth 25, prevents the cap from being rotated in the loosening direction (i.e., counter-clockwise, FIG. 2) unless the outer circumference of the skirt portion 32 of the cap is enclosed and gripped between the thumb and a finger (the index or middle finger) and rotated, which can be done only when the two finger-engaging elements 35, 36 are pressed toward each other to withdraw the projection 34 from the teeth 25. Since an adult can easily do this by so gripping the cap portion 32, whereas a child cannot, only an adult is able to remove the cap 3 from the container 2.

It will thus be seen that cap 3 can be removed only in the above-described manner. It cannot be removed by merely pinching the two finger-engaging elements 35, 36 toward each other without enclosing and gripping section 32 of the cap by the user's thumb and finger since such a rotary force (torque) would be applied along an axis which is displaced considerably from the longitudinal axis of the cap, thereby producing a tilting moment to the cap tending to cause the opposite surfaces of the cap to become wedged with respect to the container neck. The upper section 31 of cap 3 is of sufficient axial length to prevent a child from reaching the pair of finger-engaging elements 35, 36 by placing the hand over the top of the cap in order to press the two elements 35, 36 toward each other.

It is to be further noted that the teeth 25 extend only for a short distance around the circumference of the container neck, and also a short distance axially of the container neck. Thus, projection 34 is engageable with teeth 25 only when the cap has been tightened on the container neck, and therefore is effective only during the initial loosening movement to prevent rotation of the cap in the loosening direction, since once the cap has completed a full rotation around the container neck the projection 34 is no longer aligned with, but rather is displaced axially of, the teeth 25.

A still further advantage in the construction illustrated in FIGS. 1–4 is that projection 34, received within the teeth 25 in the tightened position of the cap, also serves as a locking device for locking the cap to the container neck and prevent its loosening during transportation. Thus, this construction obviates the need for separate securing devices for securing the cap to the container in order to prevent loosening of the cap during transportation.

The Embodiment of FIGS. 5–7*a*

Figure 5:
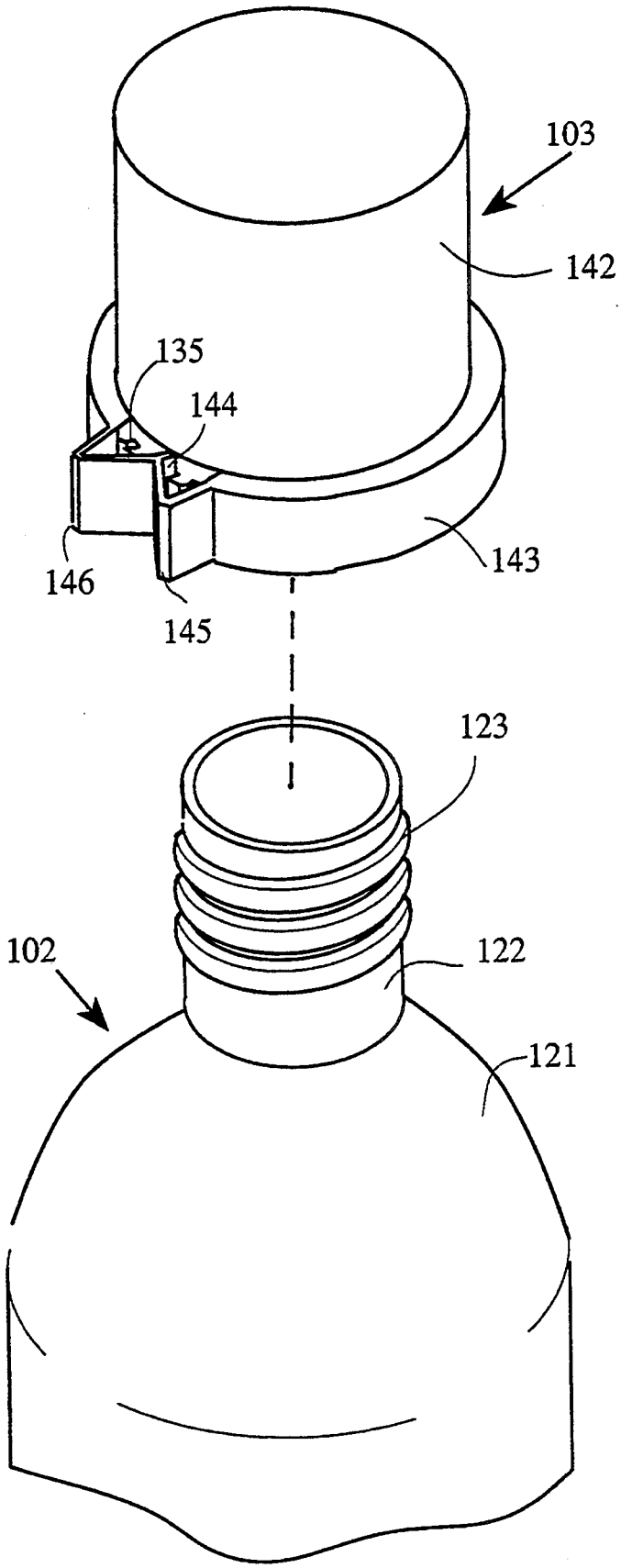
FIG. 5 is an exploded three-dimensional view illustrating a second form of closure cap constructed in accordance with the present invention.
Figure 6:
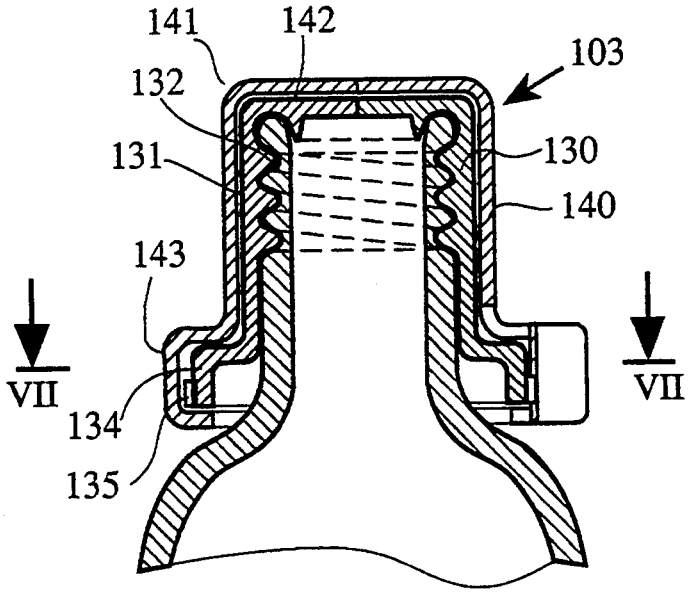
FIG. 6 is a longitudinal sectional view through the cap of FIG. 5.
Figure 7:
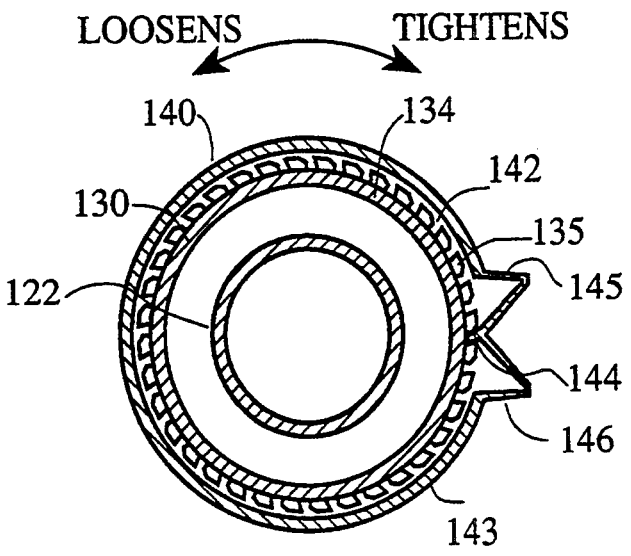
FIG. 7 is a transverse sectional view along line VII—VII of FIG. 6.

FIGS. 5–7 illustrate a container closure which can be used with existing containers of conventional construction, i.e., containers not having the ratchet teeth 25 of FIG. 1. The container closure illustrated in FIGS. 5–7, however, includes a cap of a two-part construction, rather than of a one-part construction as in FIGS. 1–4.

Thus, the container 102 illustrated in FIG. 5 may be of any existing conventional construction, including a main section 121 for holding the contents of the container, and a neck 122 formed with external threads 123.

The container cap 103 is of a two-part construction. It includes an inner part 130 and an outer part 140.

The inner cap part 130 includes an upper section 131 formed with internal threads 132 cooperable with the external threads 123 in the container neck 122, and a lower section 134 of larger diameter than the container neck 122 so as to be spaced from the container neck. The lower part 134 is formed with a plurality of external teeth 135.

The outer cap part 140 includes an upper section 141 enclosing section 131 of the inner cap part 130 with sufficient clearance 142 to permit the outer cap part to freely rotate with respect to the inner cap part 130. The outer cap part 140 futher includes a lower skirt section 143 freely enclosing the lower section 134 of the inner cap part 130 and its teeth 135. The lower section 143 of the outer cap part 140 further includes a projection 144 cooperable with teeth 135 and integrally hinged to the skirt section 143 of the outer cap part 140 by a pair of finger-engaging elements 145, 146.

The construction is such that projection 144 of the outer cap part 140 normally just enters the space between the teeth 135 of the inner cap section 130. However, the teeth 135 are configured such that the rotation of the outer cap part 140 will rotate the inner cap part 130 in the tightened direction, and also in the final loosening direction, but not in the initial loosening direction. In order to rotate the inner cap part 130 in the initial loosening direction, the two finger-engaging elements 145, 146 in the outer cap part 140 must be pressed toward each other; this causes the projection 144 to move radially inwardly into engagement with teeth 135, whereby rotation of the outer cap part 140 will thereby also rotate the inner cap part 130.

The operation of the container closure illustrated in FIGS. 5–7 will be apparent from the above description. Thus, the two-part cap 103 may be applied to the container neck 122, and the outer cap part 140 may then be rotated. The teeth 135 on the inner cap part 130 are configured such that projection 144 on the outer cap part 140 couples the outer cap part to the inner cap part, so that rotation of the outer cap part in the tightening direction will also rotate the inner cap part until the latter part is fully tightened on the container neck. In order to initially untighten the cap from the container neck, it is necessary to press the two finger-engaging elements 145, 146 toward each other, to cause projection 144 to firmly enter the space between the teeth 135 in the inner part 130 to produce a sufficient coupling between the two cap parts such that rotation of the outer cap part 140 will rotate the inner cap part 130 to untighten it from the container neck 122. As soon as the cap has been loosened with respect to the container neck, the finger-engaging elements 145, 146 may then be released, whereby the loose coupling between projection 144 and the teeth 135 would be sufficient to complete the rotation of the cap in the loosening direction.

As in the embodiment illustrated in FIGS. 1–4, the two finger-engaging elements 145, 146 are located so as not to be engageable between the tips of the finger and thumb of a child, but to so be engageable by an adult. Also, the upper sections 131 and 141 of the two parts of the cap 103 is of sufficient axial length to prevent a child from reaching the pair of finger-engaging elements 145, 146 by placing the hand over the top of the cap. Accordingly, the container closure illustrated in FIGS. 5–7 provides the same protection as in the embodiment of FIGS. 1–4 of preventing removal of the cap by a child, but permitting convenient removal by an adult, even an elderly adult.

Figure 7A:
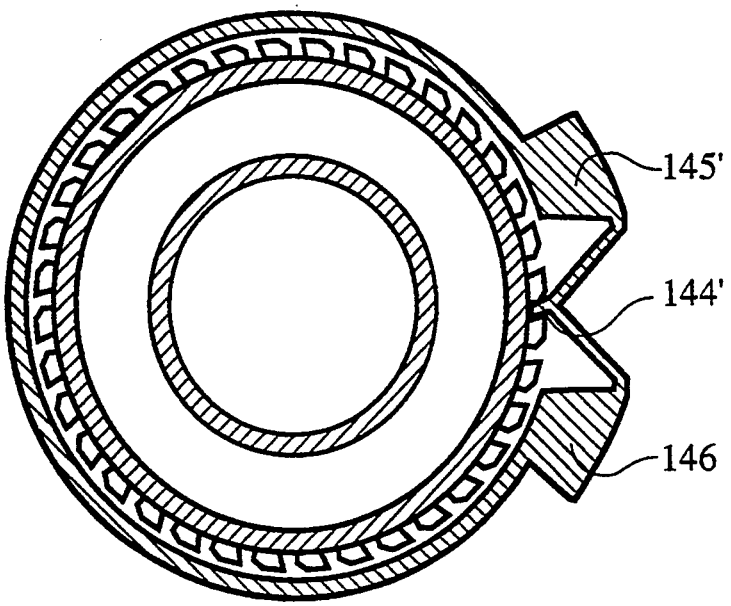
FIG. 7*a* is a view similar to that of FIG. 7, but illustrating a modification.

FIG. 7*a* illustrates a variation wherein the cap is of a construction in which the outer circumferential portion of the cap is of larger diameter than that capable of being enclosed and gripped by an adult. In such a case, the finger-engaging elements, therein designated 145' and 146', are of increased width in the circumferential direction so that their operative surfaces contacted by the user's finger and thumb are spaced the required disance, enabling them to be engaged and pressed toward each other by an adult but not by a child.

Figure 8:
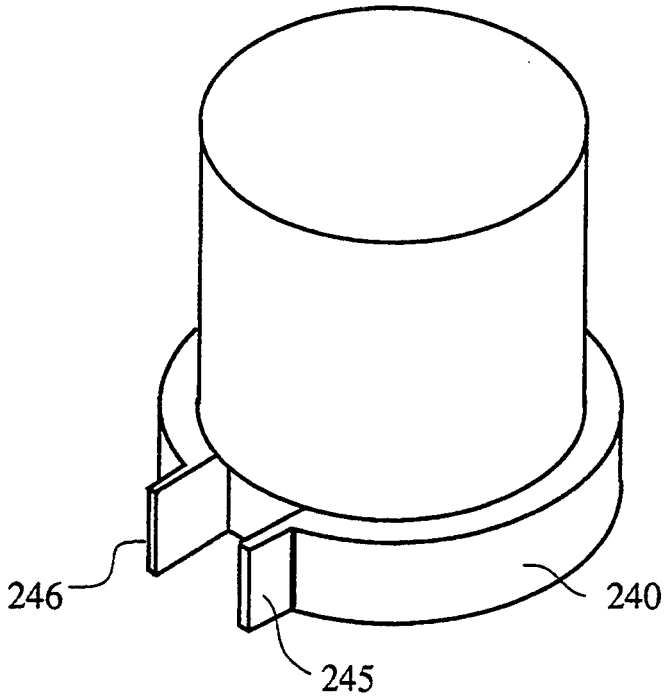
FIG. 8 illustrates a third embodiment of the invention.
Figure 8A:
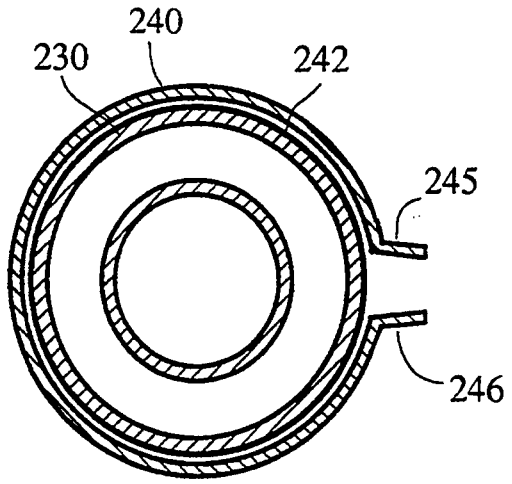
FIG. 8*a* is a transverse sectional view of FIG. 7.

The Embodiment of FIGS. 8 and 8*a*

FIGS. 8 and 8*a* illustrate a container closure which includes a cap of the same two-part construction as illustrated in FIGS. 5–7, except that the teeth 135 on the inner part, and the projection 144 on the outer part, are both omitted.

Instead, the coupling between the inner and outer parts, therein designated 230 and 240, respectively, is effected by decreasing the inner diameter of the outer part 240, so as to engage the inner part 230 when the finger-engaging elements 245 and 246 of the outer cap part 240 are pressed toward each other. Thus, the clearance 242 between the outer cap part 240 and the inner cap part 230 is sufficient such that rotating the outer cap part will have no effect on the inner cap part; but when the two finger-engaging elements 245, 246 are pressed toward each other, the inner diameter of the outer cap part 240 is decreased to cause the inner surface of the outer cap part to engage the outer surface of the inner cap part 230 sufficiently to effect a coupling between the two parts so that rotation of the outer cap part will also rotate the inner cap part. The inner surface of the outer cap part 240, and/or the outer surface of the inner cap part 230, may be roughened, knurled, or toothed for this purpose.

In all other respects, the container closure illustrated in FIG. 8 is constructed and operates in the same manner as described above with respect to FIGS. 5–7.

Figure 9:
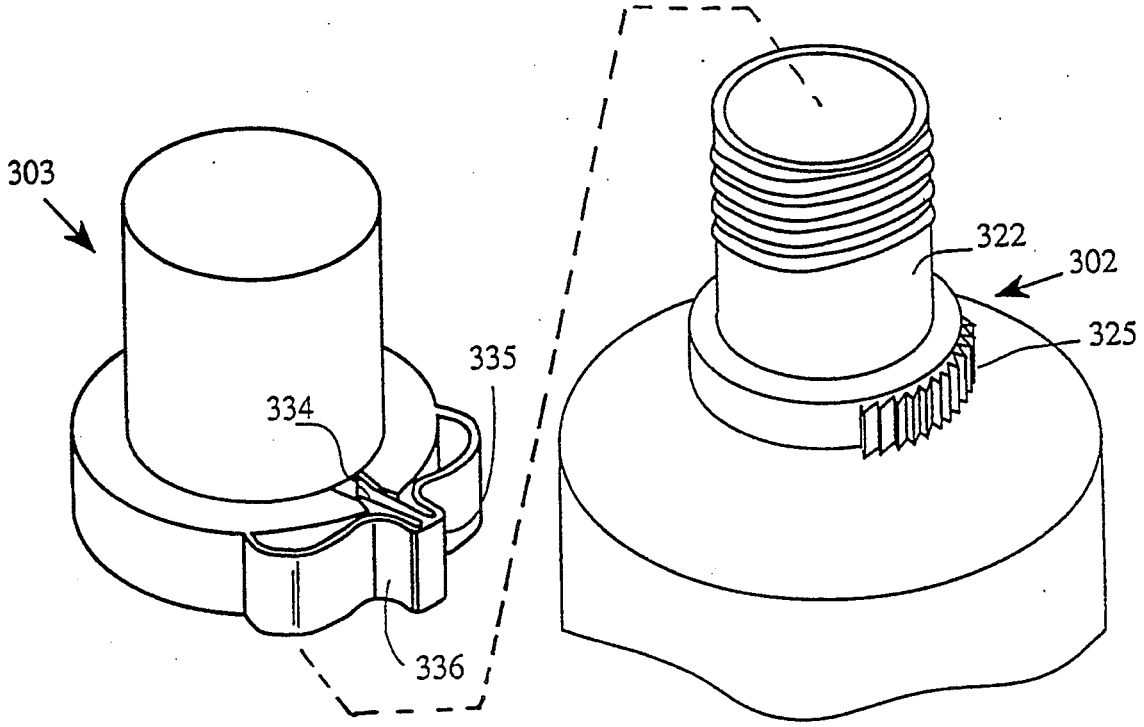
FIG. 9 illustrates a further cap and container construction in accordance with the present invention.
Figure 10:
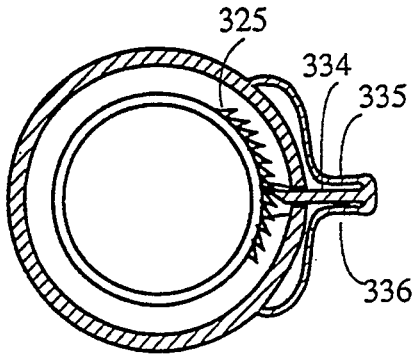
FIG. 10 is a transverse sectional view of the cap of FIG. 9.

The Embodiment of FIGS. 9 and 10

FIGS. 9 and 10 illustrate a construction similar to that of FIGS. 1–4, wherein the container 302 receives a one-part cap 303, in which the ratchet teeth 325 formed at the base of the container neck 322 cooperate with a projection 334 carried by the two finger-engaging elements 335, 336 of the cap 303. In this case, however, the finger-engaging elements 335, 336 must not only be pressed toward each other, as described above with respect to FIGS. 1–4 in order to remove the projection 334 from the teeth 325, but must also be pushed outwardly of the container neck in order to unseat the projection from the teeth. This can be easily done by an adult when enclosing and gripping the outer circumference of the cap between the index (or middle) finger and the thumb to engage the finger-engaging elements 335, 336, and then to push them outwardly of the container neck; but this can not be done by a child. In all other respects the construction illustrated in FIGS. 9 and 10, and the advantages provided by such a construction, are substantially the same as described above with respect to FIGS. 1–4.

Figure 11:
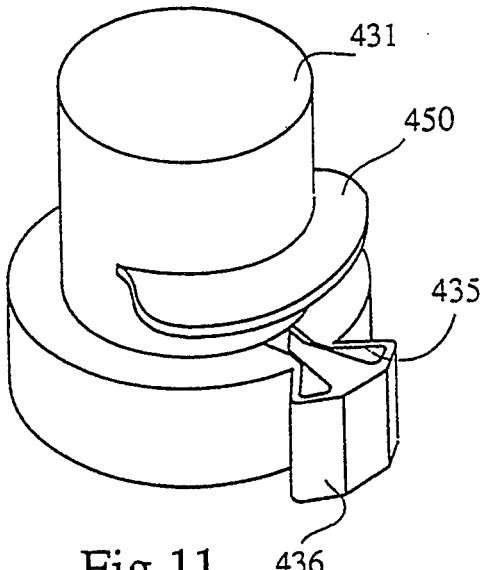
FIG. 11 illustrates a cap, similar to that shown in FIG. 1, but including a further feature of the invention.

The Embodiment of FIG. 11

As described above, the upper section of the cap (e.g., section 31 of cap 3, FIGS. 1–4) is of sufficient axial length to prevent a child from reaching the pair of finger-engaging elements (e.g., 35, 36) by placing the hand over the top of the cap. FIG. 11 illustrates a variation wherein the same function is performed by providing the upper cap section, shown at 431, with a shield 450 overlying the finger-engaging elements 435, 436. This feature is shown in FIG. 11 with respect to the cap illustrated in the embodiment of FIGS. 1–4, but it will be appreciated that it could also be provided in the cap illustrated in FIGS. 5–10.

Figure 12:
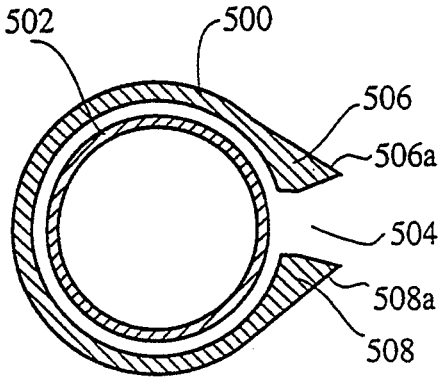
FIG. 12 illustrates a cap, similar to that of FIGS. 8 and 8*a;*
Figure 12A:
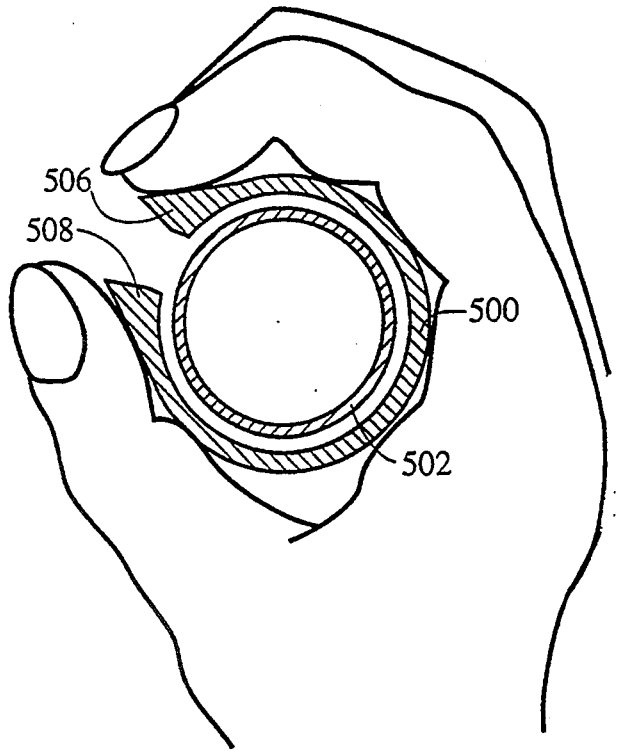
FIG. 12*a* illustrates how the cap of FIG. 12 may be removed.
Figure 12B:
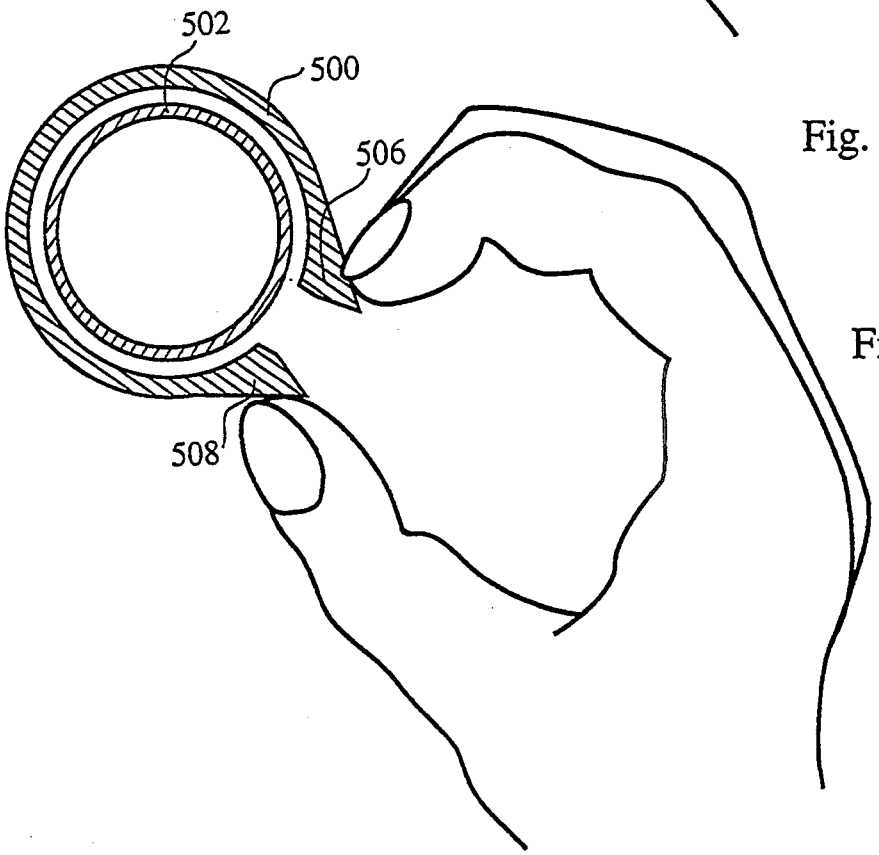
FIG. 12*b* illustrates how the cap may not be removed.

The Embodiment of FIGS. 12, 12*a* and 12*b*

FIG. 12 illustrates a cap of a two-part construction generally similar to that illustrated in FIGS. 8 and 8*a*, including an outer part 500 and an inner part 502, with the outer part being formed with a gap 504 between its two finger-engaging elements 506, 508. In the construction illustrated in FIG. 12, however, the finger-engaging elements 506 and 508 have external, slanted surfaces 506*a*, 508*a* such as to permit their being pressed together to remove the cap only when the cap is enclosed and gripped by the finger and thumb of the person attempting to open the container as shown in FIG. 12*a*. On the other hand, should the person attempt merely to pinch together the two finger-engaging elements 506, 508 in the manner shown in FIG. 12*b* (i.e., without enclosing the cap with the finger and thumb of the hand), the slanted surfaces 506*a*, 508*a* will prevent obtaining a sufficient grip on these elements to rotate the cap in order to remove it from the container.

Figure 13:
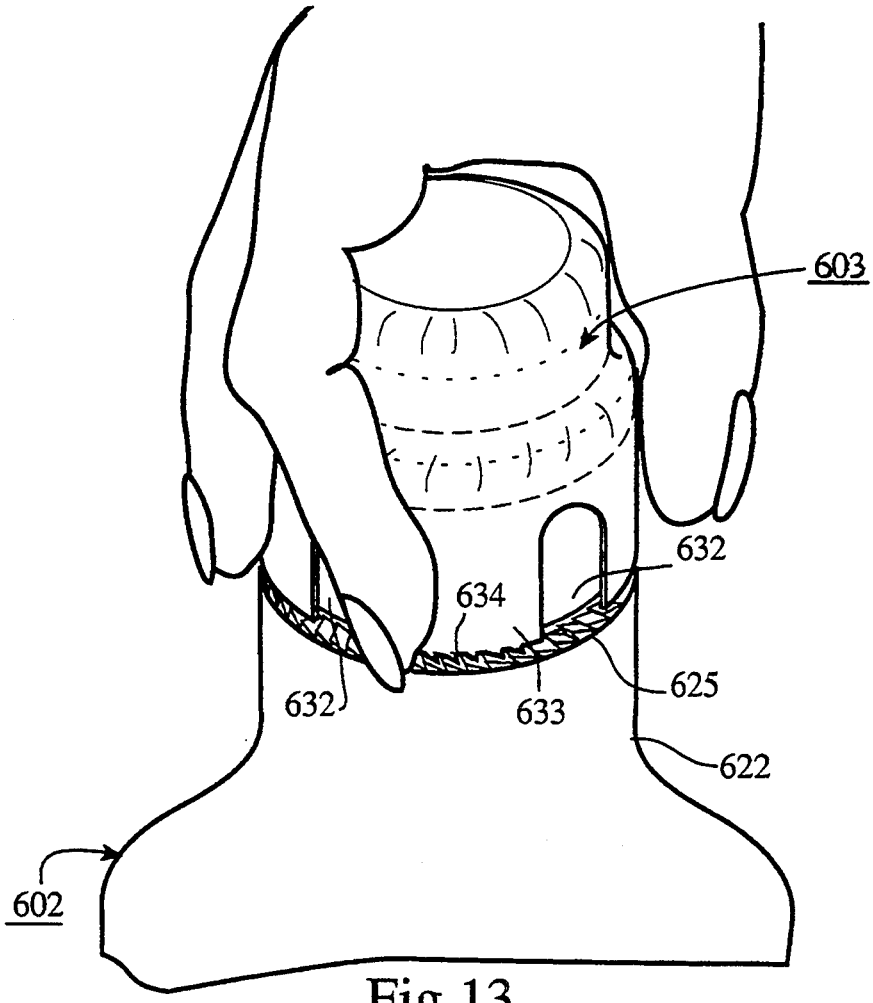
FIG. 13 illustrates a further cap construction in accordance with the present invention.
Figure 13A:
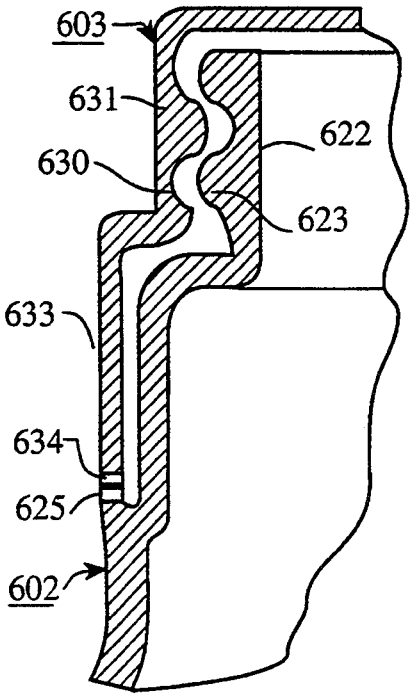
FIGS. 13*a* and 13*b* are enlarged fragmentary views of FIG. 13, FIG. 13*a* showing the normal, locking condition of the cap, and FIG. 13*b* showing the released condition of the cap to permit it to be rotated and removed from the container.
Figure 13B:
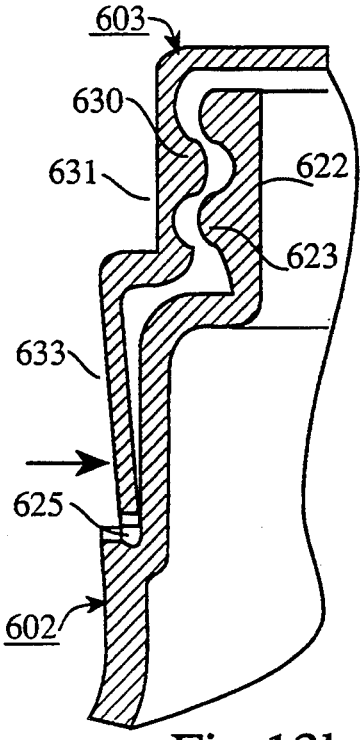

The Embodiment of FIGS. 13, 13*a* and 13*b*

FIGS. 13, 13*a* and 13*b* illustrate another child-resistant closure for a container, generally designated 602, including a cap 603 which is also constructed and dimensioned such that it can be gripped and moved to open the container by the hand of the size of an adult, but not by the hand of the size of a child.

The container 602 includes a neck 622 formed with external threads 623 cooperable with internal threads 630 formed in a section 631 of the cap 603 such that rotating the cap in one direction tightens it on the container neck, and rotating the cap in the opposite direction loosens it to permit to be removed from the container neck. Neck 622 of the container 602 is further formed with a plurality of teeth, as shown at 625. Cap 603 includes a depending skirt portion formed with a pair of axially-extending slots 632 to define a flexible depending tab 633 between the slots. The outer edge of tab 633 is formed with teeth 634 cooperable with teeth 625 on the container neck 622.

FIGS. 13 and 13*a* illustrate the normal condition of the cap 603, wherein it will be seen that teeth 634 of its tab 633 are aligned with and engage teeth 625 formed in the container neck 622. Thus, in this normal condition of the cap, the inter-engagement of teeth tab 634 with container teeth 625 lock the cap to the container and prevent the rotation of the cap, which is required to remove it from the container.

Cap 603 may be removed from the container by grasping it, as shown in FIG. 13, and pressing its tab 633 inwardly, as shown in FIG. 13*b*. When this is done, teeth 634 of the cap move out of alignment with teeth 625 of the container, thereby permitting the cap to be rotated in the untightening direction in order to remove it from the container. Flexing tab 633 inwardly is also required in order to tighten the cap onto the container.

As in the other described embodiments, cap 603 is dimensioned such that its tab 633 can be gripped and pressed inwardly in order to release the cap from the container only by the hand of the size of an adult, and not by the hand of the size of a child, thereby preventing the cap from being removed by a child.

While the invention has been described with respect to several preferred embodiments, it will be appreciated that these are set forth merely for purposes of example, and that many other variations, modifications and applications of the invention may be made.

What is claimed is:

1. A child-resistant closure for a container including a neck formed with external threads, comprising a cap formed with internal threads such that rotating the cap in one direction tightens the cad on the container neck, and rotating the cap in the opposite direction loosens the cap to permit it to be removed from the container neck; said cap having an outer circumferential portion to be enclosed and gripped by a finger and the thumb of a person to open the container; characterized in that:

said outer circumferential portion of the cap includes a pair of finger-engaging elements which are spaced apart in one circumferential direction a distance of 105–115 mm, this being less than the distance between the tips of said finger and thumb of an adult but more than that of a child, such that said finger-engaging elements can be pressed toward each other in the opposite circumferential direction when so enclosed and gripped by an adult but not by a child; said cap requiring, for its removal from the container, the pressing of said finger-engaging elements toward each other in said opposite circumferential direction when enclosed and gripped by said finger and thumb of the person attempting to open the container;

said cap including an inner cap part threadedly applied to the neck of the container, and an outer cap part including a coupling element which is normally decoupled from said inner cap part but is coupled thereto sufficient to effect loosening of the cap only when the pair of finger-engaging elements are pressed toward each other;

said inner cap part including teeth, and said coupling element of the outer cap part being a projection engageable with said teeth sufficient to effect loosening of the cap only when said pair of said finger-engaging elements are pressed toward each other.

2. A child-resistant closure for a container including a neck formed with external threads, comprising a cap formed with internal threads such that rotating the cap in one direction tightens the cap on the container neck, and rotating the cap in the opposite direction loosens the cap to permit it to be removed from the container neck; said cap having an outer circumferential portion required to be enclosed and gripped by a finger and the thumb of a person to open the container;

characterized in that: said outer circumferential portion of the cap includes a pair of finger-engaging elements which are spaced apart in one circumferential direction and require that the finger-engaging elements be pressed toward each other in the opposite circumferential direction when enclosed and gripped by a finger and the thumb of a person attempting to open the container;

said cap including an inner cap part threadedly applied to the neck of the container, and an outer cap part including a coupling element which is normally decoupled from said inner cap part but is coupled thereto sufficient to effect loosening of the cap when the pair of finger-engaging elemnts are pressed toward each other;

said outer cap part having an inner diameter normally larger than the outer diameter of the inner cap part so as to cause said coupling element to to be decoupled from said inner cap part, said outer cap part being elastic such that its inner diameter is decreased when said pair of finger-engaging elements are pressed toward each other to couple the outer cap part to the inner cap part.

3. The closure according to claim 2, wherein said finger-engaging elements have external, slanted surfaces such as to permit their being pressed together to remove the cap only when the cap is enclosed and gripped by said finger and thumb of the person attempting to open the container.

4. The closure according to claim 2, wherein said cap is of sufficient axial length to prevent reaching the pair of finger-engaging elements by placing the hand over the top of the cap.

5. The closure according to claim 2, wherein said cap includes a shield between the top of the cap and said finger-engaging elements to prevent a child from reaching the pair of finger-engaging elements by placing the child's hand over the top of the cap.

* * * * *